United States Patent [19]

Heurich et al.

[11] 4,301,730

[45] Nov. 24, 1981

[54] ANILOX ROLL AND METHOD OF MAKING THE SAME

[75] Inventors: Charles R. Heurich, Hanover; Walter A. Runck, Holmdel, both of N.J.

[73] Assignee: Pamarco Incorporated, Roselle, N.J.

[21] Appl. No.: 838,006

[22] Filed: Sep. 29, 1977

[51] Int. Cl.[3] ..... B41F 31/00

[52] U.S. Cl. ..... 101/348; 101/426; 427/423

[58] Field of Search ..... 101/348, 349, 350, 148, 101/426; 427/423, 34; 29/121.2, 121.3, 121.4, 121.5, 121.6, 121.8

[56] References Cited

U.S. PATENT DOCUMENTS

| | | | |
|---|---|---|---|
| 2,203,849 | 6/1940 | Trist | 101/170 X |
| 2,607,983 | 8/1952 | McBride | 427/423 X |
| 3,121,643 | 2/1964 | Eisenberg | 427/423 X |
| 3,285,169 | 11/1966 | Hartwig | 101/364 |
| 3,585,932 | 6/1971 | Granger | 101/350 |
| 3,613,578 | 10/1971 | Heurich | 101/350 |
| 3,655,425 | 4/1972 | Longo | 427/423 X |
| 3,723,165 | 3/1973 | Longo | 427/423 |
| 4,009,658 | 3/1977 | Heurich | 101/350 |

FOREIGN PATENT DOCUMENTS

| | | | |
|---|---|---|---|
| 1407079 | 9/1975 | United Kingdom | 101/375 |

OTHER PUBLICATIONS

Metco Technical Bulletin, "Typical Composition of Metco Sealers, Thinners . . . ", Metco Inc., 1101 Prospect Ave., Westbury, L.I., N.Y., Oct. 20, 1970.

"*Boxboard Containers*", May 1976, p. 81, Fine Screen Ceramic Rolls.

*Primary Examiner*—J. Reed Fisher

*Attorney, Agent, or Firm*—Mark T. Basseches; Paula T. Basseches

[57] ABSTRACT

The present invention is directed to an improved anilox roll for metering inks or like fluids and to the method of making the same. In accordance with the invention, a cylindrical metal roll is provided with a multiplicity of indented receiver cells in its periphery, the cells being of a selected configuration calculated to optimize the distribution of fluid therefrom, and may be of concentrations up to about 550 cells per linear inch in each direction. A ceramic coating is applied over the surface of the roll by plasma flame spray or other thermal coating techniques, known per se, the coating being formed from oxide particles having an average size of about 5 microns or less, the coating being maintained at a thickness in the order of about 0.0015" or less. The configuration of the underlying cells is, as a result of such practice, substantially maintained and the volumetric capacity of the cells defined in the coating is at least about 60% or more of the original cell volume. The thin coating, while relatively dense, does not isolate the underlying roll from the corrosive influences of liquids to be applied, the coating incorporating interstices of capillary dimension. Thereafter, unless the underlying roll is itself of corrosion resistant material, carefully controlled quantities of a low viscosity liquid carrying a resinous material in solution are applied over the ceramic coating at a rate such as to be conducted into the interior of said coating through said capillary size interstices, to seal said coating without materially reducing the volume of the cells.

5 Claims, 4 Drawing Figures

ANILOX ROLL AND METHOD OF MAKING THE SAME

BACKGROUND OF THE INVENTION

1. Field of the Invention

The present invention is in the field of metering rolls, and more particularly pertains to an anilox roll having improved wear characteristics as well as permitting high definition printing.

2. The Prior Art

It is known to provide an anilox or metering roll which comprises a cylindrical metallic core, generally plated, having formed in the periphery thereof a multiplicity of regularly spaced ink capturing cells. The objective of the anilox roll is to apply discrete increments comprising predictable quantities of ink or like fluids to a surface contacted with the roll.

It is likewise known that the results achieved are dependent upon the configuration of the dispensing cells and their concentration, the finer the cell pattern, the finer the printing possible through the use of the roll.

As an example of an advanced form of anilox roll, there may be mentioned United States Patent 3613,578 and the patents cited therein.

Since anilox rolls are exposed to corrosive fluids, it is necessary that the same be afforded a degree of protection, and typically a plating procedure wherein the cells are coated with chromium or like material is employed for such purpose.

Anilox rolls of the type hereinabove discussed are expensive to manufacture and are subject to relatively rapid wear in use, whereby their ink transfer characteristics progressively change.

It has heretofore been contemplated to apply ink with a cylindrical metal core having a ceramic coating. Such rolls, while highly wear resistant, included surface portions having random configurations whereby the ink release patterns and characteristics were unpredictable. Since such rolls failed to include the desired regularly spaced and especially shaped metering cells on their outer periphery, their utility was restricted to rough printing applications, such as corrugated boxes, wherein the reproduction of fine detail was not contemplated. Such rolls typically included relatively thick ceramic coatings, in the area of about 0.02 or 0.03" to protect the core against corrosion. In some instances a sealer was applied over the coating to define a layer which was worn away in the course of use of the roll.

More recently, in accordance with U.S. Pat. No. 4,009,658, it was proposed to provide a ceramic coated roller having regularly spaced metering cells on the outer surface thereof. In accordance with the teachings of such patent, the surface of the metallic core was first formed with a series of regularly spaced impressions or indentations of a size substantially larger than the size of the cells which were ultimately desired.

Thereafter, a ceramic coating was applied over the patterned surface to a thickness efficient to define a sealing coating, the result of such ceramic application being to provide an external ceramic surface having dispensing cells therein.

The roll of the above mentioned patent provides a practical, effective and long lived applicator roll suitable for printing processes of a far finer nature than those which might be achieved through the use of the flat or random ceramic rollers theretofore known.

However, the procedure could not produce an anilox roll capable of achieving the detail and definition comparable to all metal anilox rolls, such as the roll disclosed in U.S. Pat. No. 3,613,578 referred to above. The reason for such incapacity was that the applied ceramic coating distorted the configuration of the cells in an uncontrollable manner. Also the maximum cell concentration which might be achieved was lower than that required for fine printing applications, being in the order of from about 35 to 90 cells per linear inch whereas fine anilox printing may require cell concentrations of up to 550 cells per linear inch in each direction.

SUMMARY OF THE INVENTION

The present invention may be summarized as directed to an improved metering roll providing, for the first time in a single unit, the long life characteristics of a ceramic roll, with the fine definition heretofore achieved only with a plated metal roll.

In accordance with the invention, a cylindrical metal core has formed in the surface thereof a desired pattern of cells in cell concentrations of up to about 550 cells per linear inch in each direction, and usually in the range of from about 150 to 550 cells per linear inch. Thereafter, there is plasma-sprayed over the pattern surface a ceramic coating of especially fine grain structure, such coating being formed of particles of about 1 to 5 micron average size or less. The coating is of such thin nature, i.e. in the order of about 0.0015" or less, as to be porous and, hence, unusuable per se if applied over a conventional steel core due to the fact that the corrosive fluids with which the roll is used would rapidly penetrate the coating and attack the underlying metal, whereby the coating would flake off. The thin coating does, however, permit the configurations of the underlying cells to be accurately traced, providing on the exposed surface of the ceramic a series of dispensing cells of predictable shape. The grain structure of the coating is such as to provide a ceramic layer having capillary size interstices.

To render the roll corrosion resistan t, the ceramic surface is sprayed with fine droplets of a low viscosity liquid comprised essentially of a volatile solvent and a polymeric material, the liquid being supplied at such rate and concentration that the same travels by capillarity into the interior of the ceramic without filling or materially reducing the volume of the cells defined in the ceramic coating.

After drying and/or curing, there is formed a corrosion resistant anilox roll having a predictable cell configuration, enabling fine definition printing to be effected through the use thereof, the roll, in addition, having the high wear characteristics normally associated with ceramic.

It is accordingly an object of the invention to provide an anilox roll incorporating a ceramic coating, with its consequent high wear resistant properties which nonetheless enables printing with a definition comparable to that which may be achieved through the use of conventional metallic anilox rolls.

A further object of the invention is the provision of an improved anilox roll and method of making the same, which roll comprises a ceramic coating having external metering cells of predictable configuration in cell concentrations of from about 150 to 550 cells per linear inch.

Still a further object of the invention is the provision of a roll of the type described wherein a roll core having cells in the periphery thereof of a desired concentration and shape is covered by a porous ceramic structure of such thin nature as to minimize reduction of the volume of the cells and alteration of their shape, the ceramic layer being thereafter sprayed by a low viscosity solvent carrying a resin sealer, the resin being, by virtue of the extremely dilute nature of the solution and the capillary nature of the interstices of the ceramic defined by the particle sizes employed in the formation of the ceramic coating conducted virtually entirely into the interior of the coating to seal the ceramic without materially reducing the volume of the cells therein.

To attain these objects and such further objects as may appear herein or be hereinafter pointed out, reference is made to the accompanying drawings, forming a part hereof, in which.

Figure 1:
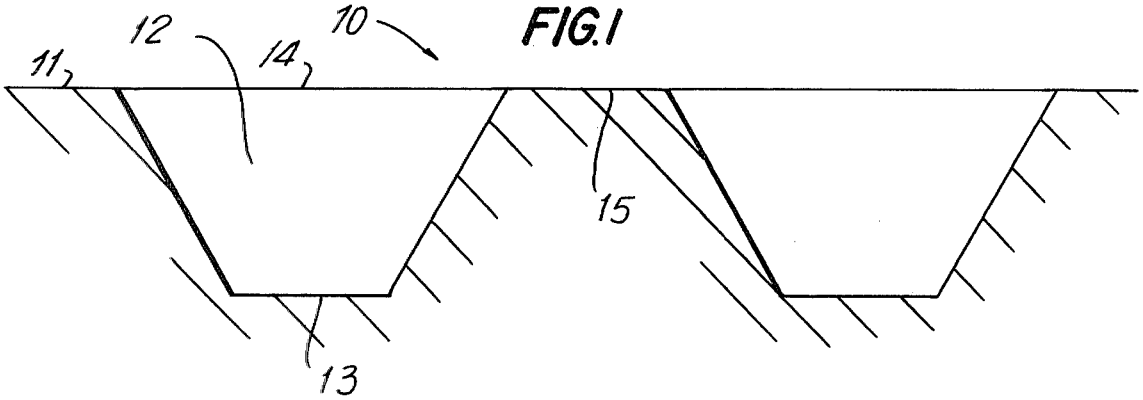
FIG. 1 is a magnified diagrammatic view, in section, illustrating the surface of a metal core having formed therein a plurality of receiver cells.

Referring now to the drawings, there is shown schematically in FIG. 1 a sectional view, in greatly magnified scale, through a roll core 10, in the periphery 11 of which has been formed a multiplicity of closely and regularly spaced receiver cells 12.

As is known in the art, receiver cells 12 are formed along the surface of the core 10 in various concentrations and configurations in accordance with the intended end use thereof. By way of example, for extremely fine printing applications, the cells 12 may be formed in concentrations of up to about 550 cells per linear inch in each direction. The cells 12 may themselves incorporate a particular geometric configuration, e.g. pyramidal or, as illustrated in the drawings, frustopyramidal, including a minor base portion 13 and a major base portion 14 coincident with the periphery 11 of the core 10. Various modifications of the geometric shape of the cells have been suggested in the art, e.g. hemispheric, conical, etc., the term "pyramidal" as used herein being intended generically to refer to a cell configuration which is broader at the surface of the roll than interiorly.

After formation of the cells 12 in the desired configuration and spacing, the metallic surface of the device is prepared so as to accept the plasma spray ceramic coating.

To this end, the surface of the core 10 is grit blasted by an abrasive compound, preferably an aluminum oxide powder. In order to achieve the desired surface preparation without unduly disturbing the configuration of the cells or peripheral surface land portions 15 between cells, grit blasting powder, in a micron size range of from about 17 to 55 microns and having an average particle size of 30 microns, is employed.

The grit blasting operation is performed through the use of conventional grit blasting equipment operating on conventional principles, care being taken, due to the abrasive nature of the materials, that the blasting operation is carried out to a minimum degree to provide a tooth for the subsequently applied coating and without materially eroding the cell configurations.

The next step in the procedure is to apply over the exposed peripheral surface 11 of the prepared roller, a porous ceramic coating. The porous coating may be applied with conventional plasma or thermal spray techniques, which are known per se. Thermal spray techniques, which are particularly described in U.S. Pat. No. 4,009,658 and various other references, involve disposing a dispensing head comprising a nozzle having a dispensing aperture or apertures adjacent the roller to be coated.

Finely subdivided particles of metallic oxide, preferaby aluminum oxide ($Al_2O_3$) of consistency as hereinafter set forth are caused to be melted and projected at high speeds, i.e. in the order of mach 1, against the surface to be coated.

The substantial momentum of the molten particles enables the nozzles to be spaced sufficiently far from the roll core to permit the still molten material to coat the core without damaging the core by the effluents. Since a wide variety of suitable thermal-plasma spray techniques may be suitably employed, the invention is not to be construed as limited to any specific method.

Preferably, the nozzle is advanced longitudinally of the core and the core is simultaneously rotated, whereby an even coating is developed over the entire exposed surface of the core.

In order to achieve the desired thin, fine grain ceramic coating without distortion of the receiver cell configurations, it has been determined that the aluminum oxide powder should be of fine consistency, and specifically the average particle size should be maintained within a range of from about 1 to 5 microns. It should be noted that this average particle size range is far smaller than that used in any thermal spray ceramic applying technique heretofore known.

The application of such unusually small particles involves difficulties, especially in the feeding of the particles, not experienced with particles of the size ranges typically employed.

In contrast to the fine materials required in the instant invention, particles heretofore used in ceramic thermal spray techniques are classified as "coarse", "fine" and "superfine."

Particles classified as "coarse" incorporate a mix of particles of a size range from 30 to 75 microns, and an average of about 50 microns; "fine" incorporates a mix of particles of a size range of from 15 to 53 microns, with an average of about 30 microns; and "superfine" incorporates a mix of particles of a size range of from 8 to 25 microns, with an average of about 14 microns.

The term average size range as used herein is intended to refer to a mix of particles of different sizes, the average size of which, in accordance with the present invention, falls within the range of 1 to 5 microns or less.

Where the roll is to have up to about 220 cells per linear inch, a ceramic powder with an average micron size of about 5 microns is preferred, whereas for rolls having finer cell structures, 1 to 2 micron average particle size powders are preferred.

The thermal spray ceramic coating operation is continued for a period necessary to create a coating thickness of about 0.0015" or less, 0.0008" being found to be optimum for the satisfactory practice of the instant invention for a fine screen (about 350 cells per lineal inch) roll.

Obviously, since a number of factors will affect the speed of coating build-up, some trial and error must be anticipated where the parameters of the procedure are to be varied. By way of example, such variables may include spacing of the nozzle from the roller surface, speed of rotation of the roller, speed of axial movement of the nozzle relative to the roller, volume per time increment at which the fuel, oxidant and particulate material are supplied, etc.

By way of example and without limitation, satisfactory coatings have been obtained on steel roll cores of from 1" to 2" diameter, utilizing an axial speed of nozzle movement relative to core of from ⅛" to ¼" per revolution of roll, the periphery of which was spaced from the nozzle a distance of about 4".

Optimum nozzle temperatures from 20,000° to 25,000° F. have been satisfactory for the application of the aluminum oxide powder in the size range about described.

Figure 2:
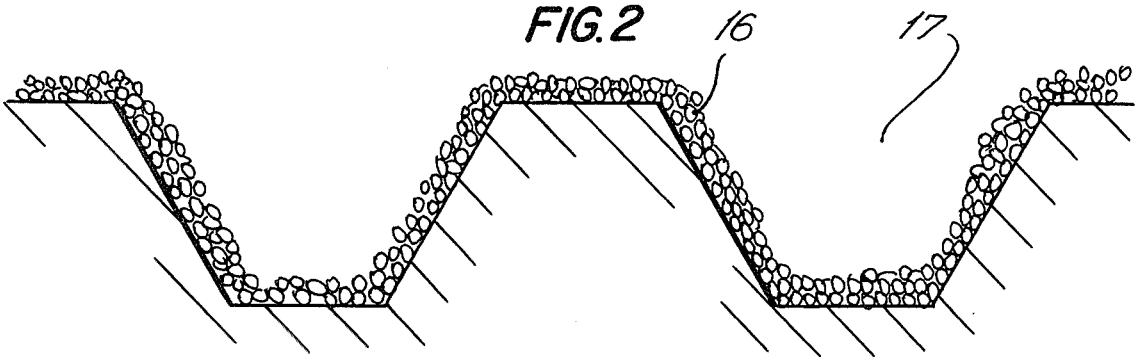
FIG. 2 is a view similar to FIG. 1, showing the core component after application of a porous ceramic layer.

The application procedure is carried out to build up a coating in the order of about 0.001". resulting in the formation of a coated core as illustrated in FIG. 2 having an over-all ceramic coating 16.

Unexpectedly, we have discovered that the use of particles whose average size is within the specified range enables the formation of a coating which is of relatively equal thickness throughout. More particularly, as noted in U.S. Pat. No. 4,009,658, the application of ceramic through conventional thermal spray techniques resulted in the formation of coatings which are substantially thicker toward the apieces of the pyramids than at the periphery of the roll, resulting in a drastic reduction of the volume of the cells in the ceramic coating as contrasted with the volume of the cells formed in the core, the ceramic cells being between one fifth and one twentieth of the volume of the covered core cells. Additionally, the configuration of the cells was drastically altered.

By utilizing particles in the size range noted, it is possible to provide an effective ceramic coating wherein the volume of the cells in the ceramic is about 60% or more of the original volume of the cells and the configuration of the cells is more or less accurately retained.

It has further been discovered that the uniformity of the coating in accordance with the instant invention is not dependent merely upon the thickness of the coating, although it is true that the thinner the coating the more accurate the reproduction of the original cell configuration and the closer the ceramic will conform to the original cell volume.

Without limitation to any specific theory for the unexpectedly superior uniformity of the coating thickness available using particles having an average size of from 1 to 5 microns, it is postulated that the smaller particles, upon impact, by virtue of their lesser mass have a lesser tendency to migrate from the point of impact to some position remote from the point of impact.

Thus, the volumetric capacity of the metering cells 17 (the term "metering cell" being used to refer to the outwardly facing cell remaining after the application of the ceramic coating) may, in accordance with the instant invention, be maintained at about 60% or more of the capacity of the receiver cells (the cells formed in the core).

The ceramic coating formed by the procedure above noted, by virtue of the particle size employed and the extremely thin nature of the coating, is unsuited for the application of ink or like corrosive substances where applied over a steel core, since the coating has capillary size interstices which would, when exposed to the ink, conduct the ink to the underlying metal layer. The inks would rapidly attack the under surface, breaking the bond between the ceramic coating and the core, and the ceramic material would rapidly become detached from the core.

In order to render the unit useful as an anilox roll where a steel core is employed, there is applied to the coating a specially compounded liquid comprising a volatile solvent and a polymer which is resistant to the corrosive influences to which the roll will be exposed. The preferred composition for application over the ceramic is an air drying, oil modified varnish having a phenolic resin base, the varnish being thinned with alcohol and aromatic hydrocarbons. A suitable material is sold by Metco Corp., Westbury, N.Y., and identified under the trademark METCOSEAL, TYPE A. P.

Various types of resinous materials carried in various types of volatile solvents have been employed satisfactorily, and it will be readily recognized that the specific resin selected may be dictated by the type of reagent to which the anilox roll will ultimately be exposed.

What is important is that the solids content (resin) be sufficiently low that the material, when applied by spraying in metered quantities per unit area, migrate into the interior of the porous ceramic layer rather than collect on the surface of the ceramic in any appreciable quantity.

In the example referred to above, the METCOSEAL, TYPE A P varnish as supplied by the manufacturer incorporates a 10% solid content. The composition is diluted, using a ketone, hydrocarbon, alcohol thinner so that the solid content is reduced to 5% of the diluted material.

A suitable thinner may comprise equal parts of ketone and aromatic hydrocarbons, with small quantities of alcohol and ester-type solvents. Various types of solvents may be employed, the selection being dependent on the nature of the resin filler used.

With the specific diluted composition described above, and utilizing a ceramic layer formed as noted and having a thickness of about 0.0008", one ounce of diluted sealer material is used for each 175 to 350 square inches of roll surface.

The quantity of sealer material to be employed may be varied in accordance with such factors as solids content of the sealant, thickness of the ceramic coat, etc. Importantly, the sealer should be applied at a rate and to an extent that it is rapidly conducted into the interior of the ceramic coat and is not permitted to accumulate on the surface of the cells and thereby reduce the volume thereof.

Figure 3:
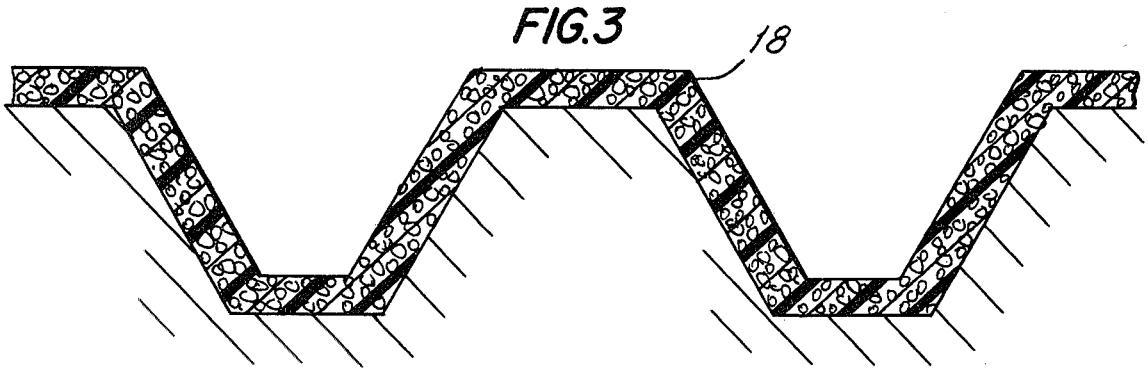
FIG. 3 is a view similar to FIG. 2 illustrating the condition of the surface after application of the resinous material.

There is shown in FIG. 3 of the drawing, an idealized representation of the roller surface after the sealer material 18 has entered into and filled the interstices of the ceramic coating.

Figure 4:
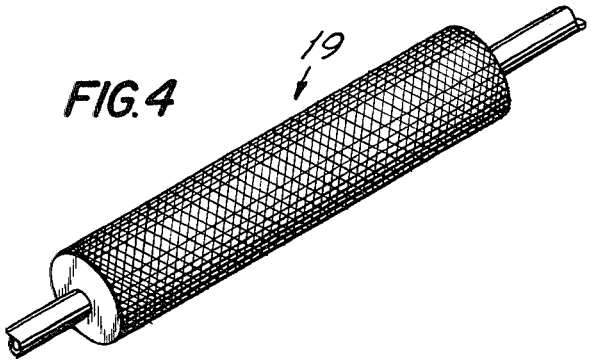
FIG. 4 is a perspective view, on a reduced scale, of the completed anilox roll in accordance with the invention.

As suggested in the diagrammatic showing, FIG. 3, the sealant material preferably does not form a coating on the interior of the cell. Thus, the volume of the cell is not reduced to any substantial extent, i.e. preferably is not reduced by 10% or more FIG. 4 constitutes a perspective representation of the finished roller 19, suitable for use in any of a variety of printing or other applications, wherein discrete metered increments of a fluid such as ink are to be transferred to an inking roll for application to a printing roll or the like.

The roll resulting from the practice of the procedure above described exhibits all of the desirable wear resistant properties normally associated with ceramic rolls while at the same time providing the capability of producing high definition printing of the type heretofore achieved only through the use of metallic and, hence, short-lived anilox rolls.

Whereas conventional ceramic rolls have heretofore employed relatively thick ceramic coatings, to bar passage of corrosive fluids to the core, the device of the present invention intentionally employs an extremely thin and, hence, permeable ceramic coating which, without further processing, would be unsuitable for use as an anilox roll where applied over a non-corrosion resistant core, as a means for preserving the configuration of closely spaced cells formed in the core, in combination with a sealant material of such nature as to flow through the surface of the ceramic and into the interior without substantially reducing the volume of the cells.

While it is anticipated that the principal usefulness of the present invention will be in conjunction with steel cores, it is within the contemplation of the invention to engrave receiver cells directly into corrosion resistant cores and apply the ceramic coating thereover, in which case the polymeric sealer may be omitted.

It will be readily appreciated by those skilled in the art that variations in the above described article and procedure may be made in the light of the disclosure hereof without departing from the spirit of the invention. Accordingly, this invention is to be broadly construed within the scope of the appended claims

Having thus described the invention and illustrated its use, what is claimed as new and is desired to be secured by Letters Patent is:

1. As a new article of manufacture, a wear and corrosion resistant anilox metering roll for the application of ink and like fluids, such roll including isolated peripheral dispensing cells of predetermined capacity and configuration, said roll comprising a cylindrical metallic core having formed in its periphery a multiplicity of depressed, regularly spaced receiver cells, in cell concentrations of from about 150 to 550 cells per lineal inch, said cells being separated at said periphery by land portions defined by the outermost extremity of said cells, said cells being of a general form of inverted pyramids, a ceramic thermal spray coating formed over said periphery, said coating being in the thickness range of about 0.0015" or less, said coating being formed from thermally applied ceramic particles of an average size range of 5 microns or less, said coating defining a series of metering cells whose volume is about 60% or more of the volume of the receiver cells, said coating being porous and incorporating interstices of capillary size, said interstices being filled with a polymeric sealer material.

2. An article in accordance with claim 1 wherein said sealer material is a polymer, said polymer being introduced into the interstices of said coating at a rate which does not materially reduce the volume of said metering cells.

3. An article in accordance with claim 2 wherein said sealer is applied in a liquid carrier medium at a rate to be substantially entirely encompassed within said porous coating under capillary influences.

4. As a new article of manufacture, a wear and corrosion resistant anilox metering roll for the application of ink and like fluids, such roll including isolated peripheral dispensing cells of predetermined capacity and configuration, said roll comprising a cylindrical metallic core of corrosion resistant material having formed in its periphery a multiplicity of depressed, regularly spaced receiver cells in cell concentrations of from about 150 to 550 cells per lineal inch, said cells being separated at said periphery by land portions defined by the outermost extremity of said cells, said cells being of a general form of inverted pyramids, a ceramic thermal spray coating formed over said periphery, said coating being in the thickness range of about 0.0015" or less, said coating being formed from thermally applied ceramic particles of an average size range of 5 microns or less, said coating defining a series of metering cells whose volume is about 60% or more of the volume of the receiver cells.

5. The method of manufacturing a corrosion and wear resistant metering roll for the application of ink and like fluids which comprises the steps of providing a cylindrical metal core, forming in the peripheral surface of said core a plurality of regularly spaced receiver cells in cell concentrations of from about 150 to 550 cells or more per lineal inch in each direction, said cells being separated at the periphery by land portions defined by the outermost extremity of said cells, said cells being of the general form of inverted pyramids, causing a thermal spray coating to be formed over said periphery, said coating being of the order of about 0.0015" or less, said coating being formed from molten ceramic particles, said particles being of an average size of 5 microns or less, said coating defining a series of cells whose volume is about 60% or more of the receiver cells, said coating including interstices of capillary size, and thereafter applying over said coating a low viscosity liquid composition comprising a polymeric sealer in liquid solvent, said composition being of such low viscosity and applied at such rate that substantially the entirety of said liquid is carried away from the surface of said coating and into the interstices thereof, and thereafter causing said solvent to evaporate, whereby said coating is sealed without substantial reduction of the volume of said metering cells.

* * * * *